US010279386B2

(12) United States Patent
Svedberg

(10) Patent No.: US 10,279,386 B2
(45) Date of Patent: May 7, 2019

(54) METHOD AND ARRANGEMENT FOR MANUFACTURING OF TUBES BY CONTINUOUS HYDRAULIC EXPANSION

(71) Applicant: SANDVIK INTELLECTUAL PROPERTY AB, Sandviken (SE)

(72) Inventor: Daniel Svedberg, Gavle (SE)

(73) Assignee: Sandvik Intellectual Property AB, Sandviken (SE)

( * ) Notice: Subject to any disclaimer, the term of this patent is extended or adjusted under 35 U.S.C. 154(b) by 70 days.

(21) Appl. No.: 15/534,164

(22) PCT Filed: Dec. 8, 2015

(86) PCT No.: PCT/EP2015/002468

§ 371 (c)(1),
(2) Date: Jun. 8, 2017

(87) PCT Pub. No.: WO2016/091376

PCT Pub. Date: Jun. 16, 2016

(65) Prior Publication Data

US 2018/0345349 A1 Dec. 6, 2018

(30) Foreign Application Priority Data

Dec. 9, 2014 (EP) ..... 14196894

(51) Int. Cl.

| | |
|---|---|
| ***B21D 26/033*** | (2011.01) |
| ***B21D 26/047*** | (2011.01) |
| ***B21D 39/20*** | (2006.01) |
| ***B21D 41/02*** | (2006.01) |
| ***B21C 23/00*** | (2006.01) |

(52) U.S. Cl.
CPC ..... *B21D 26/033* (2013.01); *B21C 23/007* (2013.01); *B21D 26/047* (2013.01); *B21D 39/20* (2013.01); *B21D 41/026* (2013.01)

(58) Field of Classification Search
CPC ..... B21D 26/00; B21D 26/02; B21D 26/033; B21D 26/039; B21D 26/043; B21D 26/045; B21D 26/047; B21D 15/03; B21D 15/10; B21D 39/203
See application file for complete search history.

(56) References Cited

U.S. PATENT DOCUMENTS 3,487,668 A * 1/1970 Fuchs, Jr. ..... B21D 26/035 72/55
4,359,889 A * 11/1982 Kelly ..... B21D 39/203 277/630

(Continued)

FOREIGN PATENT DOCUMENTS

DE 2400148 A1 7/1975
EP 0099307 A1 1/1984

*Primary Examiner* — Edward T Tolan
(74) *Attorney, Agent, or Firm* — Morgan, Lewis & Bockius LLP

(57) ABSTRACT

A method for manufacturing a tube includes continuously moving a tubular hollow blank through an expansion tool, and supplying fluid to a space delimited by the expansion tool and the tubular hollow blank the such that a hydraulic pressure is applied inside the tubular hollow blank. The magnitude of the hydraulic pressure is selected such that the tubular hollow blank is deformed plastically. The disclosure also relates to an arrangement for manufacturing a tube.

20 Claims, 3 Drawing Sheets

(56) References Cited

U.S. PATENT DOCUMENTS

| | | | | | |
|---|---|---|---|---|---|
| 4,418,556 | A * | 12/1983 | Galle | B21D 26/045 | 29/421.1 |
| 4,498,220 | A | 2/1985 | Fiegen et al. | | |
| 4,528,832 | A * | 7/1985 | Fuchs, Jr. | B21C 23/005 | 156/244.14 |
| 4,619,129 | A * | 10/1986 | Petkov | B21D 15/06 | 29/421.2 |
| 4,703,639 | A * | 11/1987 | Fuchs, Jr. | B21C 23/32 | 72/254 |
| 4,996,857 | A * | 3/1991 | Kageyama | B21D 15/10 | 72/18.6 |
| 6,176,114 | B1 * | 1/2001 | Gmurowski | B21D 15/10 | 29/421.1 |
| 6,305,204 | B1 * | 10/2001 | Tauzer | B21D 26/033 | 29/421.1 |
| 2004/0251035 | A1 * | 12/2004 | Simpson | B21D 26/033 | 166/384 |

* cited by examiner

METHOD AND ARRANGEMENT FOR MANUFACTURING OF TUBES BY CONTINUOUS HYDRAULIC EXPANSION

RELATED APPLICATION DATA

This application is a § 371 National Stage Application of PCT International Application No. PCT/EP2015/002468 filed Dec. 8, 2015 claiming priority of EP Application No. 14196894.1, filed Dec. 9, 2014.

TECHNICAL FIELD

The present disclosure relates to a method for manufacturing of tubes and an arrangement for manufacturing of tubes.

BACKGROUND ART

Seamless cold worked steel tubes but also tubes of other metal materials are usually manufactured by the following main process-steps:

Firstly, steel billets are produced by melting of scrap metal, refining in ladle and converter followed by continuous casting into strands which are cut into billets. The billets are then subjected to hot rolling to form round bars from which hollow tubular blanks are formed by piercing the round bars with a mandrel and further hot rolling or hot-extrusion. It is also possible to manufacture the hollow blanks from ingot cast steel. Finally, the hollow tubular blanks, in cold state, are either drawn or subjected to pilger-rolling to tubes of final dimensions.

Common for the final step of drawing or pilger-rolling is that the outer diameter of the hollow blanks is reduced during the working steps. When manufacturing tubes with large diameters, it is therefore necessary to use hollow tubular blanks with very large diameter as starting material. However, the forces needed to reduce the dimensions of hollow blanks increases rapidly with the size of the hollow blank and therefore increases also the size of the manufacturing equipment, i.e. draw-benches and rolling mills for both hot and cold rolling correspondingly. This results eventually in high production costs.

In the future, the demand for large diameter cold worked seamless steel tubes and the demand for large diameter cold worked seamless tubes of other materials is expected to increase, especially in oil- and gas extraction, and there is therefore a need for more efficient and less costly manufacturing methods for these products.

Consequently, it is an aspect of the present disclosure to provide an effective and cost efficient method of manufacturing tubes. A further aspect of the present disclosure is to provide an effective and cost efficient arrangement for manufacturing tubes.

SUMMARY

The above aspects are achieved by a method for manufacturing a tube 110 comprising the steps:

a. providing a tubular hollow blank 100, having a nominal outer diameter (D) and a nominal inner diameter (d);

b. providing an expansion tool 60 comprising an outer tool part 61 and an inner tool part 64 which are arranged concentrically such that the inner and outer tool parts 64, 61 defines an inlet opening 68 for receiving the tubular hollow blank 100 having a nominal outer diameter (D) and a nominal inner diameter (d) and an outlet opening 69 for a tube 110 having an outer diameter (D1) and an inner diameter (d1);

wherein the inner tool part 64 comprises a first sealing portion 65 for sealable supporting the hollow blank 100 and second sealing portion 66 for sealable supporting the tube 110, wherein a space 70 extends between the first sealing portion 65 and the second sealing portion 66 and wherein the space 70 is connected to a fluid source.

c. continuously moving the tubular hollow blank 100 through the expansion tool 60, and supplying fluid to the space 70 such that a hydraulic pressure (P1) is applied inside the tubular hollow blank 100, wherein the magnitude of the hydraulic pressure (P1) is selected such that the tubular hollow blank 100 is plastically deformed.

In the present disclosure, the hydraulic pressure is denoted P, P1, P2, P3, P4 and P5. However, as is known to the skilled person, the numerical values of the hydraulic pressure (P, P1, P2, P3, P4 and P5) may be the same or different.

The method as defined hereinabove or hereinafter is a method for expanding tubes, such as seamless tubes, wherein the tube is subjected to two types of forces, namely pressure and pulling forces. This means that the material of the tube will not be exposed to only unilateral forces (as in the commonly used processes) and the risk of cracks formed in the tube is therefore reduced.

By the method as defined hereinabove and herein after, the cross-section of the hollow blank is continuously expanded from nominal dimension into an elongated tube having thinner wall thickness and larger inner and outer diameter than the nominal hollow blank. It is thereby possible to achieve a high productivity and thus lowering the production cost per tube. Since the cross-section of the hollow tubular blanks is expanded, it is possible to use hollow tubular blanks of small nominal diameter even when manufacturing large diameter tubes.

A further advantage of the present method lies in that the hollow tubular blank is expanded by a hydraulic fluid pressure. In comparison to mechanical forming, the friction between the hydraulic pressure (P1) in the expansion tool and the hollow tubular blank will be very low. Thus, it will be possible to use small axial forces to push or draw the hollow blank through the expansion tool. This in turn, will provide advantages, such as reduced the forces required for the deformation process, small equipment size and low power consumption.

According to one alternative, the tubular hollow blank is entirely expanded by the hydraulic pressure (P1) in the expansion tool. The main advantage therewith is that there will be almost no friction (very little) friction between the hollow tubular blank and the expansion tool during the expansion process. The force necessary for moving the tubular blank through the expansion tool may therefore be very small.

According to yet one alternative, the tubular hollow blank is expanded partially by hydraulic pressure and partially by mechanical forming. A mechanical end forming step is advantageous when narrow tolerances are needed in the final tube.

The hydraulic pressure (P) acting on the hollow blank should be high enough to plasticize the material of the tubular hollow blank. Hence, the tangential tensile stress in the tubular hollow blank should lie in the plastic region of the tubular hollow blank material. In order to achieve this, it is preferred that the magnitude of the pressure in the expansion tool is selected such that the tangential tensile stress achieved in the tubular hollow blank is greater than the yield limit or the proof strength of the tubular hollow blank material. Preferably, the magnitude of the pressure in the expansion tool is selected such that the tangential tensile stress achieved in the tubular hollow blank is less than the ultimate tensile strength of the tubular hollow blank material.

According to yet an alternative, a hydraulic pressure (P3) is applied inside the tubular hollow blank, in a section of the tubular hollow blank extending from the inlet opening of the expansion tool towards the first end of the tubular hollow blank. The hydraulic pressure (P3) will stabilize the tubular hollow blank during the expansion process so that uncontrolled buckling is avoided.

According to another alternative, the magnitude of the hydraulic pressure (P3) is adapted so that tangential tensile stresses are achieved in the hollow tubular blank, wherein the tangential tensile stresses lie in the elastic region of the material of the hollow tubular. By elastically pre-tensioning the hollow tubular blank prior to expansion, the axial force needed to push the tubular hollow blank through the expansion tool may be reduced even further. Preferably, the magnitude of the hydraulic pressure (P3) is adapted so that the tangential tensile stresses achieved in the hollow tubular blank is from about 10% to about 20% less than the yield limit or proof stress of the hollow tubular blank material.

The present disclosure also relates to an arrangement for manufacturing a tube according to claim 10.

DETAILED DESCRIPTION OF THE DISCLOSURE

Figure 1:
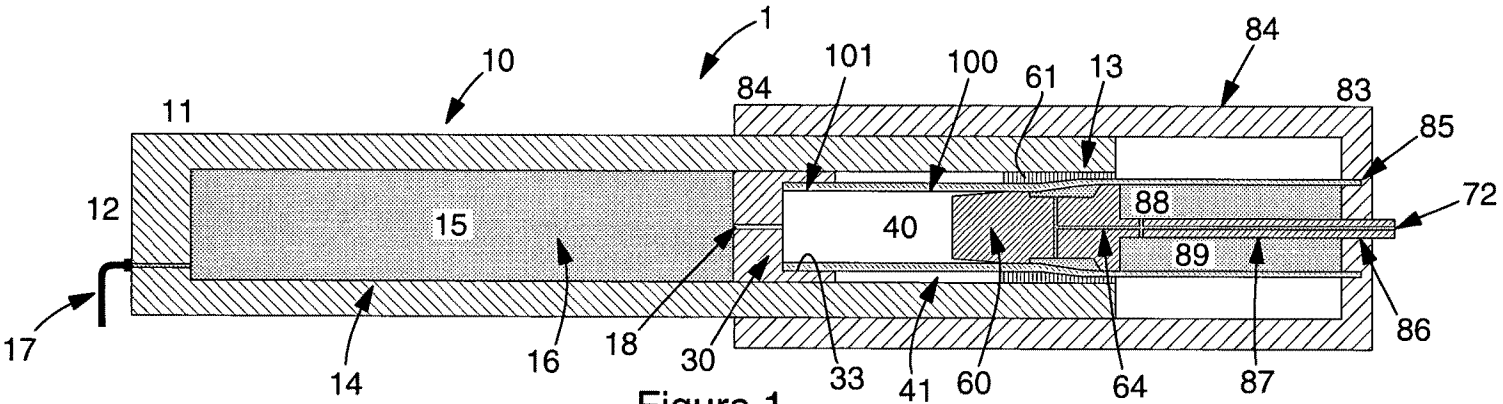
FIG. 1 is a schematically drawing of an arrangement for performing the method according to a first preferred embodiment of the disclosure.

FIG. 1 shows schematically an arrangement 1 for continuously expanding a hollow tubular blank from a nominal inner diameter d and nominal outer diameter D into an elongated tube having an inner diameter d1 and an outer diameter D1.

To facilitate the description of the arrangement 1, it is shown in operation, i.e. during expansion of a tubular hollow blank 100 into an expanded and elongated tube 110.

The arrangement comprises a first elongated tubular housing 10 having a first end 11 and a second end 13 and a circumferential cylindrical wall 14 enclosing an inner space 15. The first end 11 of the tubular housing 10 is closed by a first end wall 12.

A holding element 30 (which is also called "pushing element" or "holder element") for pushing a tubular blank is arranged in the inner space 15. The holding element 30 is a cylindrical piece which fits slidable into the inner space 15 of the first tubular housing 10. One side of the pushing element is flat and directed towards the first end 11 of the first tubular housing 10. The other side of the pushing element is directed towards the second end 13 of the first tubular housing 10 and is provided with a cylindrical recess 33, i.e. a bore, designed to receive a first end 101 of a hollow tubular blank 100 located in the inner space 15 of the first tubular housing 10.

The holding element 30, the first end wall 12 and the circumferential cylindrical wall 14 delimit a pressure chamber 16 in the inner space 15 of the first tubular housing 10. The first pressure chamber 16 is connected to a hydraulic fluid source (not shown) by a conduit 17. The pushing element 30 and the pressure chamber 16 constitute a pushing means (moving means) for pushing (moving) the hollow tubular blank.

An expansion tool 60 is arranged in the second end 13 of the first tubular housing 10. The expansion tool 60 comprises an outer tool part 61 and an inner tool part 64 which are arranged concentrically at a distance from each other.

Figure 2B:
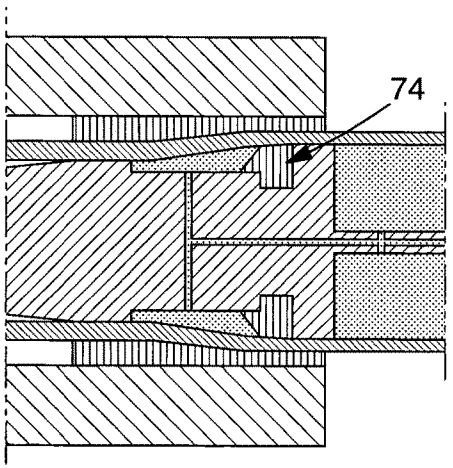
FIG. 2*b* is an enlarged view of an alternative of the arrangement according to the present disclosure
Figure 2A:
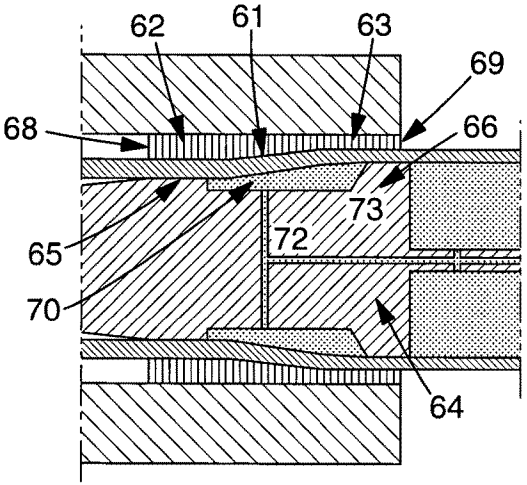
FIG. 2*a* is an enlarged view of a portion of FIG. 1

FIG. 2*a* shows an enlarged view of the expansion tool 60 according to a first alternative.

The outer tool part 61 is ring-shaped and has an inlet end 62 and an outlet end 63. The outer tool part 61 is designed so that its inner diameter increases in direction from the inlet end 62 towards the outlet end 63. Thus, at the inlet end 62, the inner diameter of the outer tool part 61 is equal to the outer diameter D of the hollow tubular blank, whereas the inner diameter in the outlet end 63 of the outer tool part is equal to the outer diameter D1 of the expanded tube. The inlet- and outlet ends 62, 63 extend cylindrically to provide support surfaces for the tubular hollow blank and the expanded tube. The exact design of the outer tool part 61 may vary, however, it is preferred that its inner diameter increases continuously from the inlet end 62 to the outlet end 63.

The inner tool part 64 is an elongated rotational symmetric solid piece and extends at least over the outer tool part 61. However, according to one embodiment, it is preferably longer than the outer tool part.

The inner tool part 64 has an inlet sealing portion 65 and an outlet sealing portion 66. The inlet section and the outlet section are cylindrical and extend in the axial direction of the inner tool part so that they form support surfaces for the inner surface of the tubular hollow blank and the inner surface of the expanded tube. The radial dimensions of the inlet sealing portion (first sealing portion) 65 and of the outlet sealing portion (second sealing portion) 66 are dimensioned so that a fluid tight seal is achieved between the inlet sealing portion 65 and the inner surface of the tubular hollow blank and between the outlet sealing portion 66 and the inner surface of the expanded tube.

An inlet opening 68 for the hollow tubular blank is defined between the inlet end 62 of the outer tool part 61 and the inlet sealing portion 65 of the inner tool part 64. An outlet opening 69 for the expanded tube is defined between the outlet end 63 of the outer tool part 61 and the outlet sealing portion of the inner tool part 64. At the inlet opening 68, the inlet end 62 of the outer tool part and the inlet sealing portion 65 of the inner tool part are in contact with the tubular hollow blank. At the outlet opening, the outlet end 63 of the outer tool part 61 and the outlet sealing portion of the inner tool part 64 are in contact with the expanded tube.

The inner tool part 64 further comprises a space 70 extending between the inlet sealing portion 65 and the outlet sealing portion 66 of the inner tool part 64. In the embodiment shown in FIG. 2*a*, the space 70 is a circumferential recess machined into the inner tool part. The circumferential recess (space) 70 may have any shape, for example rectangular cross-section, and is limited by the inlet- and outlet sections 65, 66 and by the bottom of the inner tool part 64.

The circumferential recess 70 is thus open towards the upper tool part and extends over at least a portion of the upper tool part. The circumferential recess 70 is connected to a source of hydraulic fluid (not shown in figure) by a conduit 72. In operation, the circumferential recess 70 and the inner surface of the tubular hollow blank delimit a pressure chamber so that a hydraulic pressure is applied on inner surface of the tubular hollow blank. The depth of the circumferential recess 70 is selected in dependency of the dimensions of the hollow tubular blank and so that a uniform hydraulic pressure will be formed circumferentially around the tubular hollow blank.

A side 73 of outlet sealing portion 66 may be beveled to guide the hollow tubular blank towards the outlet opening 69 of the expansion tool in the initial stage of the expansion process.

It is also possible to design the inner tool part 64 so that the tubular hollow blank is partially deformed hydraulically by the fluid in circumferential recess 70 and partially deformed mechanically between the outlet sealing portion 66 and the outer tool part 61. It is advantageous to adjust the final dimensions of the expanded tube, but also to ensure a complete fluid tight seal to the expanded tube in the outlet opening of the expansion tool.

FIG. 2*b* shows a second alternative of the expansion tool 60 in which the outlet sealing portion 66 has a mechanical forming section 74 extending concentrically along the outer tool part 61 so that a ring-shaped gap is formed between the forming section 74 and the outer tool part 61. The forming section 74 is dimensioned so that the ring-shaped gap gradually narrows in direction towards the outlet opening 69. Thus, in FIG. 2*b*, the hollow tubular blank is partially expanded against the upper tool part 61 by a hydraulic pressure P1 in the circumferential recess 70 and partially by mechanical forming in the ring-shaped gap between the upper tool part 61 and the forming section 74. The forming section 74 may be an integral part of the outer sealing portion or a separate part.

Returning to FIG. 1, the arrangement 1 for continuously expanding a hollow tubular blank further comprises a second tubular housing 80 for receiving the expanded tube 110. The second tubular housing 80, comprises a circumferential wall 81. A bottom wall closes the second end 83 of the second tubular housing 80 and its first end 84 is open.

The second tubular housing 80 is arranged in slidable contact with the first tubular housing 10. The second end 13 of first tubular housing 10, i.e. which comprises the expansion tool 60 is thereby inserted into the open first end 84 of the second tubular housing 80. The bottom wall 82 of the second tubular housing comprises an annular groove 85 for receiving the end of the expanded tube. A hydraulic chuck (not shown) may be provided adjacent to the annular groove 85 for clamping the end of the expanded tube.

A rod 86 extends from the inner tool part 64 through the bottom wall of the second tubular housing 80. A main fluid channel 87 extends through the rod 86 for connecting the circumferential recess 70 in the inner tool part with a source of hydraulic pressure (not shown). The rod also comprises an outlet channel 88 for supplying hydraulic fluid to the interior of an expanded tube located in the second tubular housing.

In operation of the arrangement 1, the axial force pushing the hollow tubular blank through the expansion tool also forces the inner tool part 64 out through the end of the first tubular housing 10. To prevent this, the expanded tube 110, the bottom wall of the second tubular housing and the inner tool part 64 delimits a pressure chamber 89 which is connected to a fluid source (not shown) via the outlet channels 88 in the rod 86. When a fluid is supplied in the pressure chamber 89, a counter hydraulic pressure P2 is applied on the inner tool part 64 which forces the inner tool part to remain in position during the expansion of the hollow tubular blank.

According to an alternative of the present disclosure, the arrangement for expanding a hollow blank may further comprise a fluid channel 18, which connects a hydraulic fluid source (not shown) with the interior of the hollow tubular blank in a portion of the hollow tubular blank which extends from the inlet end of the expansion tool towards the holder element 30. As can be identified in FIG. 1, the circumferential wall of the tubular hollow blank 1, the holder element 30 and the expansion tool 60 delimit a pressure chamber 40 which may be pressurized in order to stabilize the tube during and throughout the process.

In the arrangement 1 for expanding a hollow blank, there is a ring-shaped slot 41 between the outer surface of the hollow tubular blank and the circumferential wall 14 of the first tubular housing 10. The purpose of the ring-shaped slot 41 is to accommodate the lateral movement of the hollow tubular blank during the expansion process. According to an alternative, the ring-shaped slot 41 may also be connected by a fluid channel to a hydraulic fluid source and pressurized. By providing a hydraulic pressure P4 in the ring-shaped slot 45, the tubular hollow blank may be stabilized during the expansion process.

Instead of using hydraulic pressure to move the holder element 30 with the tubular blank towards the expansion tool, it is possible to use mechanical force. For example, by using a push rod connected to a linear motor.

It is also possible to push the tubular hollow blank through the expansion tool and simultaneously pull the second tubular housing away therefrom.

It is further appreciated that the arrangement for manufacturing a tube comprises necessary sealing elements to prevent the hydraulic fluid from leaking out between the various components of the arrangement. Appropriate sealing elements may for example be arranged in the inlet- and outlet openings of the expansion tool. It is further appreciated that the connection to the hydraulic fluid sources includes the necessary pumps and valves in order to achieve suitable pressures.

The method according to the disclosure will in the following be described with reference to FIGS. 3*a*-3*c*.

Figure 3A:
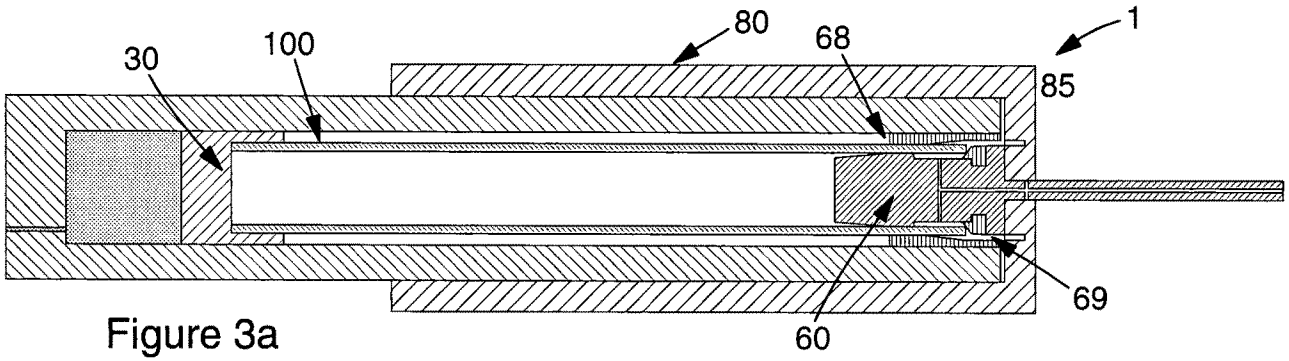
FIGS. 3*a*-3*c* shows schematically three different stages of the method according to the present disclosure.

FIG. 3*a* shows the arrangement 1 for expanding a hollow tubular blank in starting position. Thus, the pushing element 30 is retracted towards the first end of the first tubular housing. The second tubular housing 80 has been retracted such that its bottom wall 85 is in near proximity to the outlet opening 69 of the expansion tool 60.

A tubular hollow blank 100 is placed in the inner space 15 of the first tubular housing. The first end of the tubular hollow blank is inserted in the cylindrical recess 33 of the pushing element 30. The second end of the tubular hollow blank is inserted into the inlet opening 68 of the expansion tool 60. The tubular hollow blank is manufactured from steel such as stainless steel, such as duplex stainless steel or high alloy stainless steel. Examples of steel are those of UNS S32750 and UNS n08028 (which may be bought from AB Sandvik Materials Technology). The tubular hollow blank may have an inner diameter d of 132 mm an outer diameter D of 160 mm and a length of 8900 mm. However, the tubular hollow blank may also be made from other metallic material, such as aluminum, copper, carbon steel or zirconium.

The circumferential wall of the hollow tubular blank delimits the circumferential recess 70 so that a fluid tight pressure chamber is achieved.

Figure 3B:
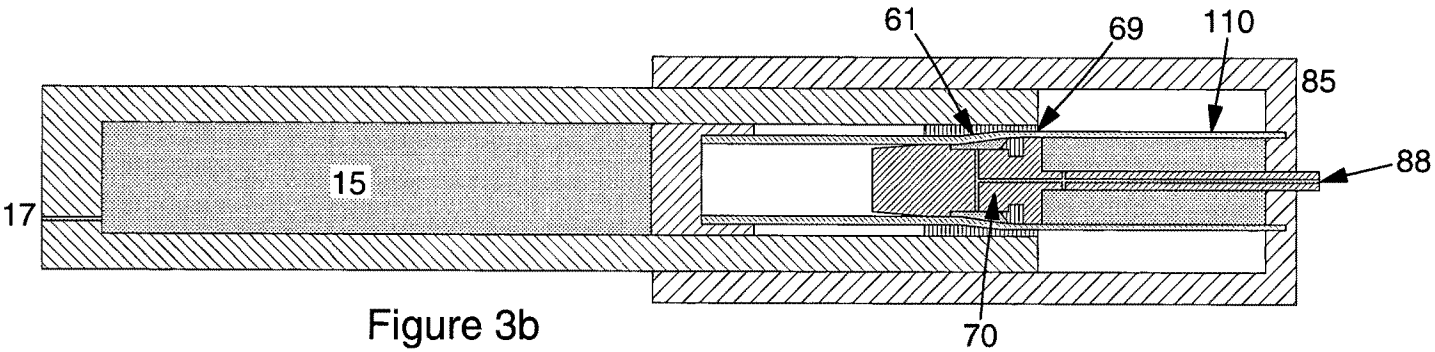

In a second step, see FIG. 3*b*, the circumferential recess 70 is pressurized to a hydraulic pressure P1 by a hydraulic fluid introduced through channel 88. The hydraulic pressure P1 acts on the inner surface of the hollow tubular blank.

The magnitude of the hydraulic pressure P1 in the circumferential recess 70 is selected so that a tangential tensile stress is achieved in the hollow tubular blank of such magnitude that the material of the hollow tubular blank plasticizes. This will cause the hollow tubular blank to deform uniformly in radial direction towards the outer tool part 61. The high pressure not only expands the inner diameter of the tubular hollow blank, it also reduces the wall thickness of the hollow tubular blank. Therefore, in comparison to the hollow tubular blank, the resulting expanded tube is longer and has a reduced wall thickness.

This may be also explained accordingly; the highly pressurized fluid in the circumferential recess 70 acts on the inner surface of the plasticized hollow tubular blank. Thus, the plasticized hollow tubular blank is squeezed between the outer tool part 61 and the highly pressurized hydraulic fluid, which in turn will result in a reduced wall thickness for the tubular hollow blank.

The relationship between the magnitude of the hydraulic pressure and plasticizing of the tubular hollow blank will be explained later in the text below.

Simultaneously with the above, also the pressure chamber 16 in the first tubular housing is pressurized to a hydraulic pressure P5 by a hydraulic fluid introduced through channel 17. This forces the holder element 30 to move towards the expansion tool 60 and causes the hollow tubular blank to move continuously through the expansion tool.

The expanded tube 110 exits the expansion tool through the outlet opening 69 and engages the end wall 85 of the second tubular housing 80 which starts to slide on the first tubular housing away from the expansion tool. This procedure stabilizes the expansion process and makes it proceed at a stable velocity.

Figure 3C:
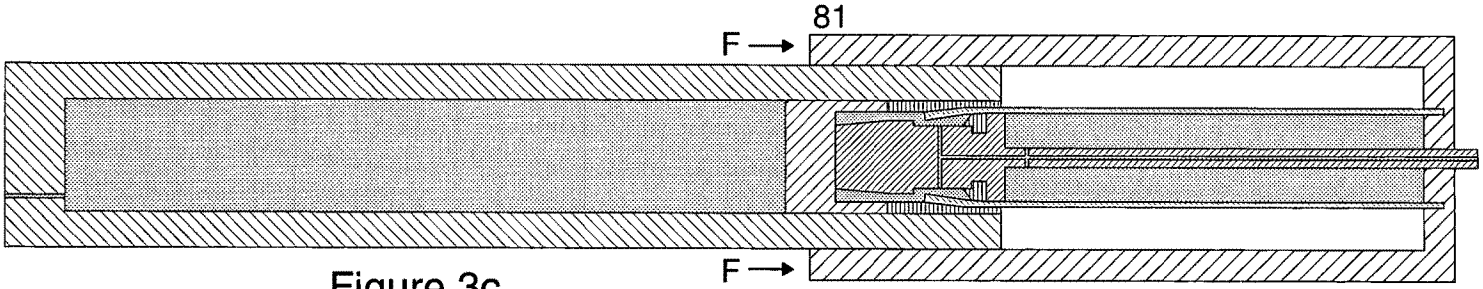

FIG. 3*c* shows the arrangement for expanding a tubular blank in its end position. The holder element 30 has been pushed, by the hydraulic pressure P5 in pressure chamber 16, to a position close to the inlet opening 68 of the expansion tool. In this position, the holder element cannot push the hollow tubular blank further through the expansion tool. Instead, the last portion of the hollow tubular blank is pulled through the expansion tool by the second tubular housing. This may be achieved by applying a force F on the first end 81 of the second tubular housing or by gripping the second end of the second tubular housing and pulling it in a direction away from the expansion tool. The pressure in the circumferential recess 70 may be increased to facilitate removal of the last section of the expanded tube from the expansion tool.

The magnitude of the hydraulic pressure P1 in the circumferential recess 70 is critical for expanding and elongating the tubular hollow blank. The importance of the hydraulic pressure will be explained more in detail below.

When a pressure, i.e. a load, is applied inside the tubular hollow blank, tangential stress is formed in the wall of the tubular hollow blank.

The behavior of metallic materials when subjected to increasing loads is well known and is typically described by so-called stress-strain diagrams.

When a piece of metal material is subjected to a small load, the stresses formed cause the distance between the atoms in the metal material to increase without affecting their mutual arrangement. If the load is removed, the metal material piece reverts to its original dimension. The metal material piece is thus deformed elastically. In the stress-strain diagram, this region is usually called the linear-elastic region. If the load applied on the metal material piece is increased, the stress will also increase. When the stress passes the so-called elastic limit or yield limit, the atom planes will begin to slide over one another and the metal material piece undergoes permanent deformation, i.e. the metal material piece is deformed plastically. The plastic deformation increases homogenously in the metal material piece with increasing load until the stress in the metal material piece reaches the so-called ultimate tensile stress. After this point, a waist starts to form in the metal material piece and if the load is increased further, the test piece will eventually give away. The region between the yield limit and the ultimate tensile stress is typically called the plastic region.

For metal materials, there is not a defined yield limit. Instead, the term "proof strength" is used to determine the start of the plastic region. The proof strength is defined as the amount of stress which causes 0.2% remaining elongation of the material. Typically the proof strength is denoted $Rp_{0.2}$.

The yield point, the proof stress and the ultimate tensile stress are documented for most construction metal materials, or may easily be determined through experiments. In the disclosed method, this information may be used to determine the magnitude of the hydraulic pressure necessary for deforming, i.e. expanding, the hollow tubular blank.

Following is an example describing the calculation of a sufficient hydraulic pressure for deforming a tubular hollow blank.

The tubular hollow blank has an inner diameter of 132 mm and a wall thickness of 14 mm. The tubular hollow blank was manufactured from hot-rolled steel of the type UNS S32750, which is commercially available from AB Sandvik Materials Technology.

The proof strength ($Rp_{0.2}$) of this particular type of steel is 550 MPa.

The pressure P necessary for plasticizing the tubular blank may be calculated with the following equation:

$$P = \frac{\sigma * 2 * W_t}{D}$$

Figure 4A:
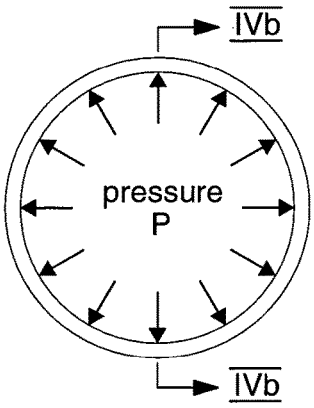
FIGS. 4*a* and 4*b* are explanatory drawings for an illustrative example of the method according to the present disclosure.
Figure 4B:
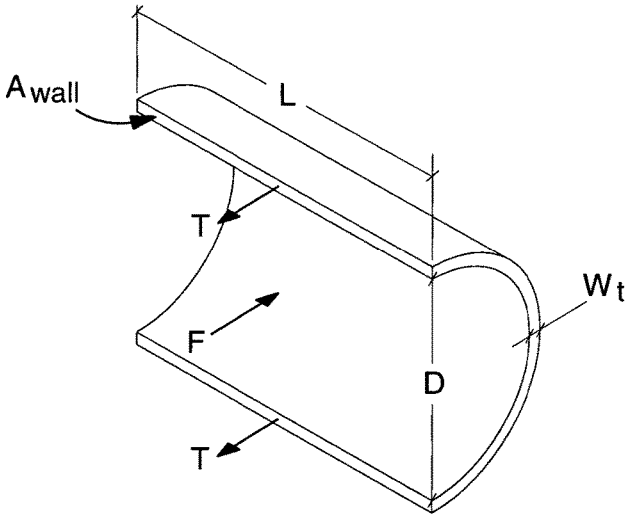

This equation is derived by considering the tangential stress σ in a cylindrical tank subjected to an internal pressure P, see FIGS. 4*a* and 4*b*.

The length of the tank is L, the inner diameter is D, the wall thickness $W_t$ and the area of the wall is $A_{wall}$. The forces F acting on the tank are the total pressure P and the total tension in the wall of the tank is T.

$$F = PA$$

$$T = \sigma_t A_{wall} = \sigma_t tL$$

$$\Sigma F_H = 0$$

$$F = 2T$$

$$PDL = 2(\sigma_t tL)$$

-continued $$P = \frac{\sigma * 2 * W_t}{D}$$

During deformation, the tubular hollow blank strain hardens which in turn increases the resistance to deformation. This effect needs to be considered in the calculation. Based on experience a higher proof strength, i.e. 1000 MPa is therefore used in the equation.

$$P = \frac{\sigma * 2 * W_t}{D} = \frac{1000 * 2 * 14}{132} = 212 \text{ MPa}$$

Thus, to plasticize and deform the hollow tubular blank a pressure of at least 212 MPa must be applied on the inner surface of the hollow tubular blank.

The invention claimed is:

1. A method for manufacturing a tube comprising the steps:

a. providing a tubular hollow blank, having a nominal outer diameter and a nominal inner diameter;

b. providing an expansion tool including an outer tool part and an inner tool part arranged concentrically such that the inner and outer tool parts define an inlet opening for receiving the tubular hollow blank and an outlet opening for a tube having an outer diameter and an inner diameter, wherein the inner tool part includes a first sealing portion for sealably supporting the hollow blank and second sealing portion for sealably supporting the tube, wherein a space extends between the first sealing portion and the second sealing portion, the space being connected to a fluid source, wherein the outer tool part includes an inlet end and an outlet end, and wherein an inner diameter of the outer tool part increases in a direction from the inlet end towards the outlet end; and c. continuously moving the tubular hollow blank through the expansion tool, and supplying fluid to the space such that a hydraulic pressure is applied inside the tubular hollow blank, wherein the magnitude of the hydraulic pressure is selected such that the tubular hollow blank is deformed plastically.

2. The method for manufacturing a tube according to claim 1, wherein a magnitude of the hydraulic pressure is selected such that a tangential tensile stress formed in the hollow tubular blank is in the plastic region of a material of the hollow tubular blank.

3. The method for manufacturing a tube according to claim 1, wherein a magnitude of the hydraulic pressure is selected such that a tangential tensile stress formed in the hollow tubular blank is equal to or greater than a proof strength of a material of the hollow tubular blank.

4. The method for manufacturing a tube according to claim 1, wherein a magnitude of the hydraulic pressure is selected such that a tangential tensile stress formed in the hollow tubular blank is equal to or greater than a tensile strength of a material of the hollow tubular blank.

5. The method for manufacturing a tube according to claim 1, wherein the tubular hollow blank is deformed partially by the hydraulic pressure and partially by mechanical deformation.

6. The method for manufacturing a tube according to claim 1, wherein a second hydraulic pressure is applied in a portion of the tubular hollow blank which extends from the inlet opening of the expansion tool towards a first end of the tubular hollow blank.

7. The method for manufacturing a tube according to claim 6 wherein the magnitude of the second hydraulic pressure is selected such that a tangential tensile stress formed in the hollow tubular blank is in an elastic region of a material of the tubular hollow blank.

8. The method for manufacturing a tube according to claim 1, wherein the hollow tubular blank is continuously moved through the expansion tool by a force acting on a first end of the tubular hollow blank in direction towards the expansion tool.

9. The method for manufacturing a tube according to claim 1, wherein a material of the tubular hollow blank is steel or stainless steel or duplex stainless steel or high alloyed stainless steel.

10. The method for manufacturing a tube according to claim 1, wherein the outer tool part is ring-shaped.

11. The method for manufacturing a tube according to claim 1, wherein the inner diameter of the outer tool part continuously increases from the inlet end to the outlet end.

12. The method for manufacturing a tube according to claim 1, wherein the second sealing portion of the inner tool part includes a mechanical forming section extending concentrically along the outer tool part and forming a ring-shaped gap between the forming section and the outer tool part, wherein the forming section is dimensioned so that the ring-shaped gap gradually narrows in direction towards the outlet opening, and wherein the hollow tubular blank expands by mechanical forming in the ring-shaped gap when the tubular hollow blank is continuously moved through the expansion tool.

13. An arrangement for manufacturing a tube comprising:

a first tubular housing arranged to receive a tubular hollow blank;

an expansion tool including an outer tool part and an inner tool part arranged concentrically such that the inner and outer tool parts define an inlet opening for receiving a tubular hollow blank having a nominal outer diameter and a nominal inner diameter and an outlet opening for an expanded tube having a tube outer diameter and a tube inner diameter; and a pushing element arranged to push the tubular hollow blank through the expansion tool, wherein the inner tool part includes a first sealing portion sealably supporting the hollow blank and a second sealing portion sealably supporting an expanded tube, wherein a space extends between the first sealing portion and the second sealing portion, the space being connected to a fluid source, wherein the outer tool part includes an inlet end and an outlet end, and wherein an inner diameter of the outer tool part increases in a direction from the inlet end towards the outlet end.

14. The arrangement for manufacturing a tube according to claim 13, wherein the outer tool part is ring-shaped.

15. The arrangement for manufacturing a tube according to claim 13, wherein the second sealing portion of the inner tool part includes a forming section arranged to mechanically deform the hollow tubular blank against the outer tool part.

16. The arrangement for manufacturing a tube according to claim 15, wherein the forming section is arranged concentrically with the outer tool part and is dimensioned such that a gradually narrowing gap is provided between the forming section and the outer tool part.

17. The arrangement for manufacturing a tube according to claim 13, further comprising a second tubular housing having a circumferential wall and a bottom wall, wherein the second tubular housing is slidably arranged on the first tubular housing and arranged to receive the expanded tube.

18. The arrangement for manufacturing a tube according to claim 17, wherein the second tubular housing includes a fluid channel for supplying fluid inside the expanded tube received in the second tubular housing.

19. The arrangement for manufacturing a tube according to claim 13, wherein the inner diameter of the outer tool part continuously increases from the inlet end to the outlet end.

20. The arrangement for manufacturing a tube according to claim 13, wherein the second sealing portion of the inner tool part includes a mechanical forming section extending concentrically along the outer tool part and forming a ring-shaped gap between the forming section and the outer tool part, and wherein the forming section is dimensioned so that the ring-shaped gap gradually narrows in direction towards the outlet opening.

* * * * *